US008528902B2

(12) United States Patent
Katayama

(10) Patent No.: US 8,528,902 B2
(45) Date of Patent: Sep. 10, 2013

(54) SHEET CONVEYING APPARATUS AND IMAGE FORMING APPARATUS WITH DIFFERENTIAL ROLLER DIAMETERS

(75) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/307,126

(22) Filed: Nov. 30, 2011

(65) Prior Publication Data

US 2012/0153557 A1 Jun. 21, 2012

(30) Foreign Application Priority Data

Dec. 17, 2010 (JP) ..... 2010-281486

(51) Int. Cl.
*B65H 5/02* (2006.01)

(52) U.S. Cl.
CPC ..... *B65H 5/025* (2013.01)
USPC ..... 271/277; 271/270; 271/272; 271/3.21; 271/3.2

(58) Field of Classification Search
USPC ..... 271/265.01, 270, 272, 277, 3.21, 271/3.2
See application file for complete search history.

(56) References Cited

U.S. PATENT DOCUMENTS 4,480,825 A * 11/1984 Landa ..... 271/272
4,659,073 A * 4/1987 Leonard ..... 271/272
4,941,655 A * 7/1990 Winkler ..... 271/272
5,365,323 A * 11/1994 Ando ..... 271/270
6,595,517 B1 * 7/2003 Tranquilla ..... 271/275
7,621,519 B2 11/2009 Sagawa et al.
8,342,500 B2 * 1/2013 Katayama ..... 271/270
8,444,135 B2 * 5/2013 Morita et al. ..... 271/265.01
2007/0057444 A1 3/2007 Sagawa et al.
2008/0203649 A1 * 8/2008 Watase et al. ..... 271/277
2009/0026691 A1 1/2009 Ishikawa et al.
2011/0127709 A1 * 6/2011 Katayama ..... 271/277

FOREIGN PATENT DOCUMENTS

JP 11-043238 A 2/1999

* cited by examiner

*Primary Examiner* — Gerald McClain
(74) *Attorney, Agent, or Firm* — Fitzpatrick, Cella, Harper & Scinto

(57) ABSTRACT

A sheet conveying apparatus includes a curve-shaped conveying path conveying a sheet from a first conveyance direction toward a second conveyance direction, a drive conveying portion conveying the sheet in the second conveyance direction by a pair of mutually-pressed rollers, and a belt conveying portion conveying the sheet toward the drive conveying portion by an endless belt member, wherein the belt conveying portion is configured to include a first belt support roller which is arranged coaxially with one of the pair of rollers and a second belt support roller which is arranged at an upstream side of the drive conveying portion from the first belt support roller, to wind the belt member around the first and second belt support members, and to set an outer diameter of the first belt support roller including the belt member to be smaller than an outer diameter of the one roller.

8 Claims, 12 Drawing Sheets

SHEET CONVEYING APPARATUS AND IMAGE FORMING APPARATUS WITH DIFFERENTIAL ROLLER DIAMETERS

BACKGROUND OF THE INVENTION

1. Field of the Invention

The present invention relates to a sheet conveying apparatus having a structure to convey a sheet from a first conveying path to a second conveying path which are mutually merged, and more specifically, relates to the sheet conveying apparatus enabling to reduce noise at the time of sheet conveyance from the first conveying path to the second conveying path and an image forming apparatus including the sheet conveying apparatus.

2. Description of the Related Art

Recently, with an image forming apparatus such as a copying machine, noise caused by a sheet itself occurring during sheet conveyance becomes striking according to gradual reduction of operation noise. For example, a top end of a sheet S to be conveyed from a conveying path 30 causes top end hitting noise when being abutted to a vertical conveying path 45 at a merging section (i.e., a curved portion) where the conveying path 30 and the conveying path 45 are at a right angle, as illustrated in FIG. 12A. Further, as illustrated in FIG. 12B, a rear end of the sheet S causes rear end bounce noise as being abutted to a guide face of the conveying path 45 when reaching the merging section after passing through the conveying path 30.

In the related art, to solve such a noise problem, there has been known an image forming apparatus which reduces noise caused by abutment of a sheet conveyed through a sheet conveying path by arranging a flexible sheet such as mylar (registered trademark) at a merging section where two sheet conveying paths are merged (see Japanese Patent Laid-open No. 11-043238).

However, with the above structure in which sheets are abutted to the flexible sheet, since top ends and rear ends of sheets are abutted to the same part of the flexible sheet repeatedly for each sheet, there is a possibility of losing capability of sheet conveyance owing to scrape or breakage of the flexible sheet with use.

Further, there has been known an image forming apparatus having a structure to reduce noise occurring when a sheet conveyed from a first pair of rollers at the upstream side is abutted to a merging section on a midstream toward a second pair of rollers at the downstream side in a curved sheet conveying path (see U.S. Patent Application Publication No. 2009/0026691 A1). In the image forming apparatus, a guide plate having holes formed and having sound absorbing material fixed at a back face thereof is arranged at the merging section (i.e., a curved portion).

However, with the above structure in which holes are formed at the sheet conveying path and the sound absorbing material is arranged at the back face thereof, it is difficult to obtain a sufficient effect of noise reduction as a result of that a face to which a sheet is directly abutted is formed of a rigid member such as a metal plate. Here, a member having low rigidity for noise reduction can be utilized. However, since durability is decreased when a low rigidity member is utilized, it has been difficult to satisfy both of high noise reduction performance and durability.

Meanwhile, there has been proposed an apparatus including mutually-merged first and second sheet conveying paths and a belt conveying portion which is moved to guide sheets to the second sheet conveying path with a structure to enhance noise reduction performance by abutting top ends and rear ends of sheets to the belt conveying portion (see U.S. Patent Application Publication No. 2007/0057444 A1).

The above apparatus includes the first conveying path which conveys a sheet with a first conveying portion, the second conveying path which conveys a sheet with a second conveying portion as being merged to the first conveying path at the downstream side, and the belt conveying portion which cushions abutment of a sheet as being arranged at the second conveying path.

Incidentally, with the apparatus enhancing noise reduction performance by abutting top ends and rear ends of sheets to the belt conveying portion, the first conveying portion includes split-like rubber drive rollers formed of a roller body separated in plural in an axial direction as a drive roller. Here, since the split-like rubber drive rollers arranged at the belt conveying portion in an opposed manner are abutted to a rubber-made endless belt at the belt conveying portion, sheets are to be nipped by the rubber-made roller body and the rubber-made endless belt. Accordingly, frictional charging difference becomes large between a nipped part and an un-nipped part of a sheet owing to the roller body and the endless belt which are made of rubber. That is, charges are kept at the sheet as a result of frictional charging of the sheet at the nipped part between the roller body and the endless belt while few charges are kept at the un-nipped part. In an image forming apparatus of an electrophotographic system, a toner image is transferred to a sheet by applying transfer bias to a transfer portion. Therefore, when frictional charging difference occurs on the sheet, there is a possibility to cause imaging instability. Accordingly, it is not preferable to perform nipping and conveying with a conveying member causing contact of rubber to an image transfer face of a sheet.

To address the above issues, the present invention provides a sheet conveying apparatus having a structure not to cause imaging failure while enabling to reduce noise occurring at a curved portion of a conveying path of which conveying direction is varied and an image forming apparatus including the sheet conveying apparatus.

SUMMARY OF THE INVENTION

A sheet conveying apparatus includes a curve-shaped conveying path which conveys a sheet being conveyed in a first conveyance direction toward a second conveyance direction which is curved against the first conveyance direction, a drive conveying portion which is arranged at the curve-shaped conveying path and which conveys the sheet in the second conveyance direction with a nip of a pair of mutually-pressed rollers, and a belt conveying portion which is arranged at a curved portion of the curve-shaped conveying path and which conveys the sheet conveyed in the first conveyance direction toward the drive conveying portion with rotation of an endless belt member, wherein the belt conveying portion is configured to include a first belt support roller which is arranged coaxially with one of the pair of rollers and a second belt support roller which is arranged at an upstream side of the drive conveying portion from the first belt support roller, to wind the belt member around the first and second belt support members, and to set an outer diameter of the first belt support roller including the belt member to be smaller than an outer diameter of the one roller.

According to the present invention, the belt member is not contacted to the one roller when the sheet conveyed in the first conveyance direction is conveyed toward the second conveyance direction. Thus, sheets can be conveyed only by the nipping of the pair of rollers. Accordingly, it is possible to reliably prevent occurrence of inconvenience such as imaging instability due to frictional charging difference of the related art. In this manner, it is possible to avoid occurrence of imaging failure while reducing noise occurring at the vicinity of the curved portion of the curve-shaped conveying path.

Further features of the present invention will become apparent from the following description of exemplary embodiments with reference to the attached drawings.

DESCRIPTION OF THE EMBODIMENTS

First Embodiment

Figure 1:
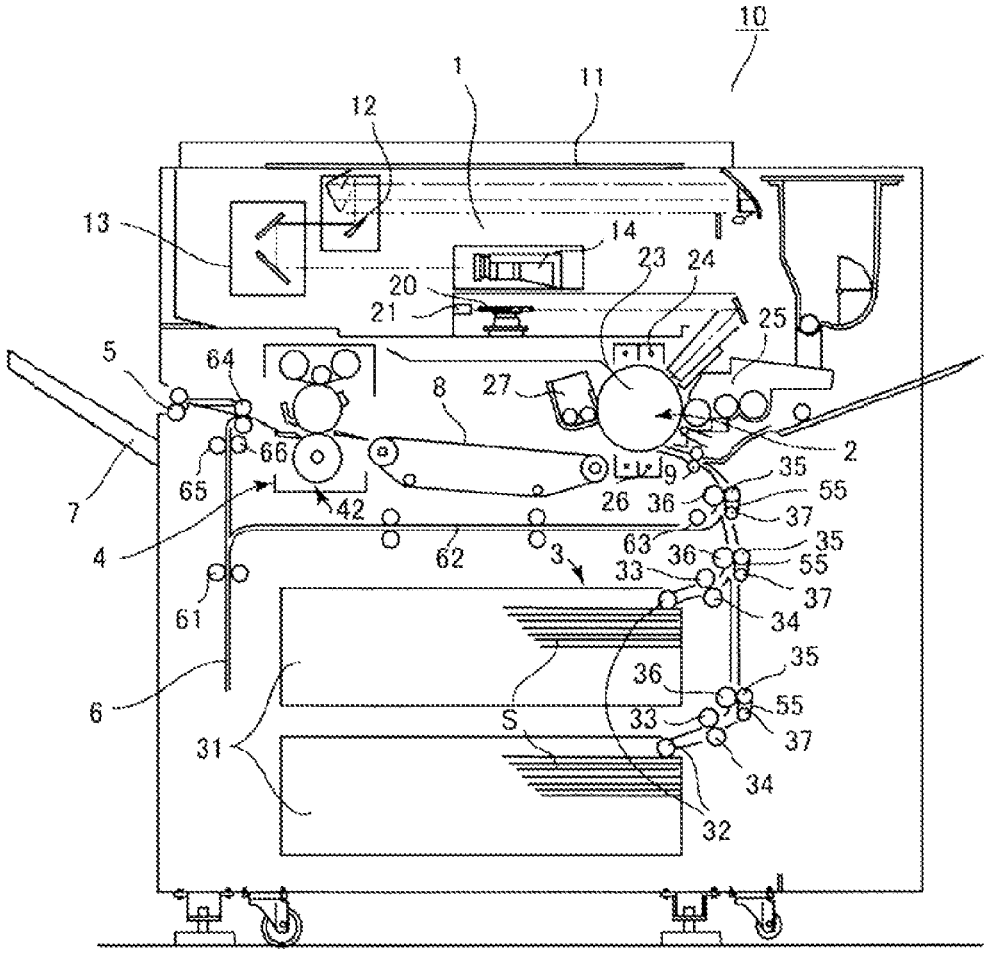
FIG. 1 is a sectional view illustrating a printer being an example of an image forming apparatus including a sheet conveying apparatus according to the present invention.

In the following, embodiments of the present invention will be exemplarily described in detail with reference to the drawings. FIG. 1 is a sectional view illustrating an image forming apparatus 10 including a sheet conveying apparatus according to the present invention.

As illustrating in FIG. 1, the image forming apparatus 10 includes a reader portion 1 which reads an original and an image forming portion 2 which forms an image (i.e., a toner image) on a sheet conveyed from a sheet conveying apparatus with an electrophotographic system based on the read original. Further, the image forming apparatus 10 includes a sheet feeding portion 3 which feeds a sheet to the image forming portion 2 and a transfer charger 26 to which bias is applied for transferring a toner image formed at the image forming portion 2 to the sheet. Furthermore, the image forming apparatus 10 includes a fixing portion 4 which fixes the toner image transferred to the sheet, a pair of discharge rollers 5 which discharges the image-fixed sheet, and a reversing portion 6 which reverses faces of the image-fixed sheet. In the following, detailed structures are described in order from the reader portion 1.

[Reader portion 1] An original (not illustrated) placed on an original base plate glass 11 is irradiated by a scanning optical system 12 having a light source and a reflection mirror set. The reflection light is imaged at a CCD 14 via a reducing lens 13, and then, is photoelectrically converted and A/D-converted.

[Image forming portion 2] A laser light emitting portion 21 scans a photosensitive drum 23 with laser light owing to rotation of a polygon mirror 20 based on image information read by the reader portion 1 and forms a latent image on the photosensitive drum 23 which is previously charged by a charger 24. A development device 25 develops the latent image and forms a toner image on the photosensitive drum 23. The transfer charger 26 transfers the toner image formed on the photosensitive drum 23 to a sheet S. After the toner image is transferred, remaining toner on a drum face is removed by a cleaning portion 27.

[Sheet feeding portion 3] A sheet cassette 31 in which sheets S are stacked and accommodated is detachably attached at a lower part of the image forming apparatus 10. The sheets S fed by a pick-up roller 32 are separated and a sheet is conveyed by a conveying roller 33 and a retard roller 34. Then, the sheet S is skew-feeding corrected by a registration portion 9 and is conveyed to the image forming portion 2.

[Fixing portion 4] The sheet S to which the toner image transferred at the image forming portion 2 is conveyed to a fixing portion 4 by a conveying belt 8. The fixing portion 4 is provided with a pair of rollers 42 which includes a heat roller having a halogen heater (not illustrated) at the inside thereof and a pressure roller which is pressed to the heat roller with predetermined pressing force by a spring (not illustrated). The sheet S on which non-fixed toner is placed is heated and pressurized when passing through a nip of the pair of rollers 42. Accordingly, the toner image is melted and fixed. In a one-sided copy mode, the sheet S after the fixing process is discharged to the outside of an apparatus body by the pair of discharge rollers 5 and is stacked on a discharge tray 7.

[Reversing portion 6] In a duplex copy mode, the sheet S is conveyed to the reversing portion 6 by a pair of switchback rollers 61 after passing through the fixing portion 4. Subsequently, the sheet S is conveyed to a duplex conveying path 62 owing to reverse rotation of the pair of switchback rollers 61 and is conveyed to the registration portion 9 by a re-feeding roller 63 for newly forming an image. Then, the sheet S is discharged to the outside of the apparatus body through the same process as the one-sided copy mode. Here, FIG. 1 illustrates a conveying wheel 35, a conveying roller 36, a second belt support roller 37, a conveying belt 55 being an endless belt member, and conveying rollers 64, 65.

Figure 2:
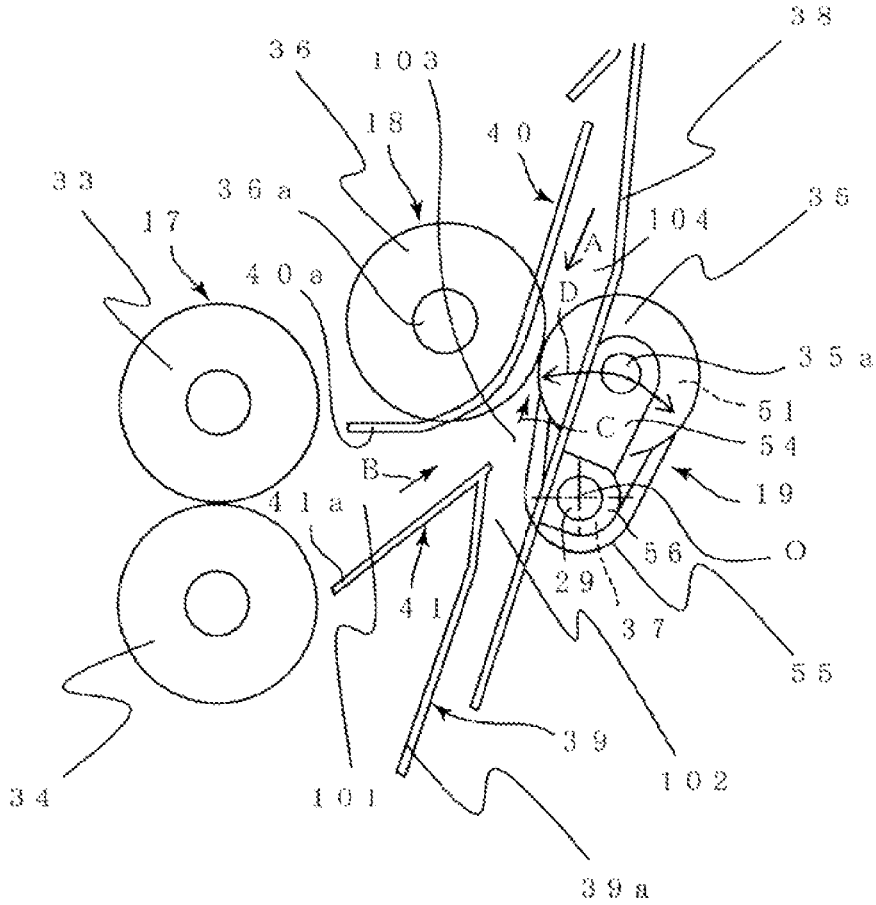
FIG. 2 is a side view illustrating a structure of a main part of the first embodiment of the present invention.
Figure 3:
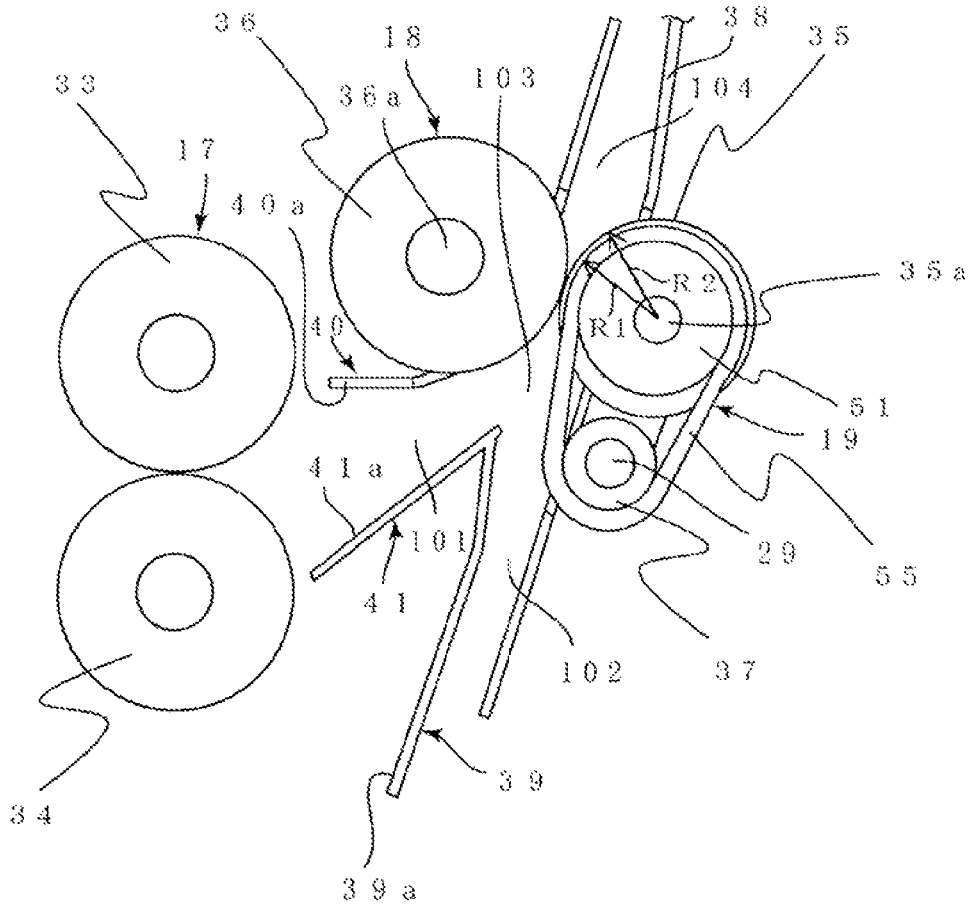
FIG. 3 is a sectional view illustrating a tension state of an endless conveying belt in the first embodiment.
Figure 4A:
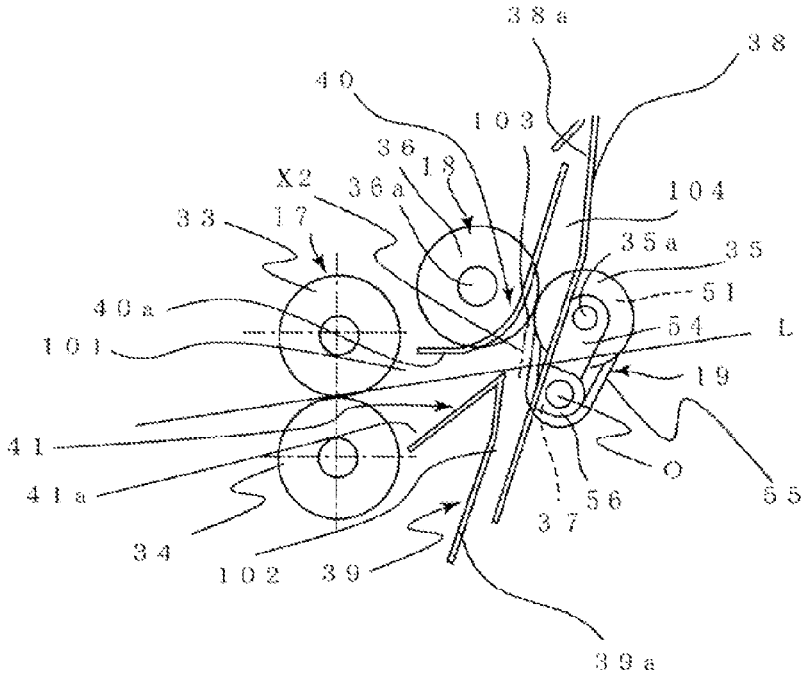
FIG. 4A is a side view illustrating arrangement of the conveying belt in the first embodiment and FIG. 4B is a plane view illustrating a state of a nip of a conveying roller and a conveying wheel in the first embodiment as viewed from the direction of arrow A in FIG. 2.

[Structure of conveying portion] Next, the structure of a section where sheet conveying paths are merged after feeding will be described in detail with reference to FIGS. 1 to 4. FIG. 2 is a side view illustrating a structure of a main part of the first embodiment of the present invention. FIG. 3 is a sectional view illustrating a tension state of the endless conveying belt of the first embodiment. FIG. 4A is a sectional side view illustrating a winding support state of the conveying belt 55 formed of the endless belt member.

In the present embodiment, description is performed mainly on a structure in which the present invention is applied to a belt conveying portion 19 at a section having the conveying roller 33, the retard roller 34, the conveying wheel 35 and the conveying roller 36 which convey sheets S fed from each sheet cassette 31 at upper and lower stages toward the image forming portion 2. Here, not limited to the above, it is natural that the present invention can be applied to a belt conveying portion at a section having the re-feeding roller 63, the conveying wheel 35 and the conveying roller 36 which feed sheets S fed from the duplex conveying path 62 once again to the image forming portion 2.

As illustrated in FIGS. 1 and 2, a first conveying path 101 extended in a lateral direction to convey a sheet S with the conveying roller 33 and the retard roller 34 is arranged at a merging section of the sheet conveying paths after feeding. Further, a second conveying path 104 and a third conveying path 102 extended in a vertical direction (i.e., straightly in an up-down direction) and intersecting at an end point of the first conveying path 101 are arranged at the merging section. The first conveying path 101, the second conveying path 104 and the third conveying path 102 are mutually connected at a curved portion 103.

That is, the sheet conveying apparatus includes a curve-shaped conveying path which conveys a sheet S being conveyed in a first conveyance direction (i.e., the direction of arrow B) toward a second conveyance direction (i.e., the direction of arrow C) which is curved against the first conveyance direction. The curve-shaped conveying path includes the first conveying path 101, the curved portion 103 and the second conveying path 104.

Further, the sheet conveying apparatus includes a second conveying portion 18 which conveys the sheet S in the second conveyance direction with the nip of the conveying roller 36 and the conveying wheel 35 being a pair of mutually-pressed rollers arranged at the downstream side of the curve-shaped conveying path from the curved portion (i.e., the downstream side from the curved portion 103). In addition, the sheet conveying apparatus includes the belt conveying portion 19 which is arranged at the curved portion 103 of the curve-shaped conveying paths (101, 103, 104) and which passes (i.e., conveys) the sheet S conveyed in the first conveyance direction toward the second conveying portion 18 owing to rotation of the conveying belt 55 being the endless belt member. The belt conveying portion 19 includes a first belt support roller 51, a second belt support roller 37, and the conveying belt 55. The belt conveying portion 19 is arranged at a side where the conveying belt 55 is contacted to an image transfer face of the conveyed sheet S.

The second conveying portion (i.e., a drive conveying portion) 18 includes the conveying roller 36 being a drive roller which is rotated receiving driving force and the conveying wheel 35 which is driven and rotated as being pressed to the conveying roller 36 in the second conveying path 104. Further, the conveying roller 33 and the retard roller 34 structure a first conveying portion (i.e., another drive conveying portion) 17 which is arranged at the first conveying path 101 and which conveys the sheet S in the first conveyance direction (i.e., the direction of arrow B).

Further, the belt conveying portion 19 includes the first belt support roller (i.e., a tension wheel) 51 which is arranged coaxially with the conveying wheel 35 being one of the pair of rollers (36, 35). In addition, the belt conveying portion 19 includes the second belt support roller (i.e., a tension wheel) 37 which is arranged at the upstream side of the second conveying path 18 from the first belt support roller 51. The conveying belt 55 is wound around the first and second belt support rollers 51, 37 (i.e., the first and second belt support rollers). Here, the outer diameter R1 (see FIG. 3) of the first belt support roller 51 including the conveying belt 55 is set to be smaller than the outer diameter R2 (see FIG. 3) of the conveying wheel 35.

In short, as illustrated in FIGS. 3 and 4A, the conveying belt 55 is looped over and stretched between the first belt support roller 51 which is supported by a rotation shaft 35*a* being coaxial with the conveying wheel 35 and the second belt support roller 37 which is supported by a rotation shaft 29 at the upstream side thereof. As described above, the outer diameter R1 where the conveying belt 55 is wound around the first belt support roller 51 is set to be smaller than the outer diameter R2 of the conveying wheel 35.

Figure 4B:
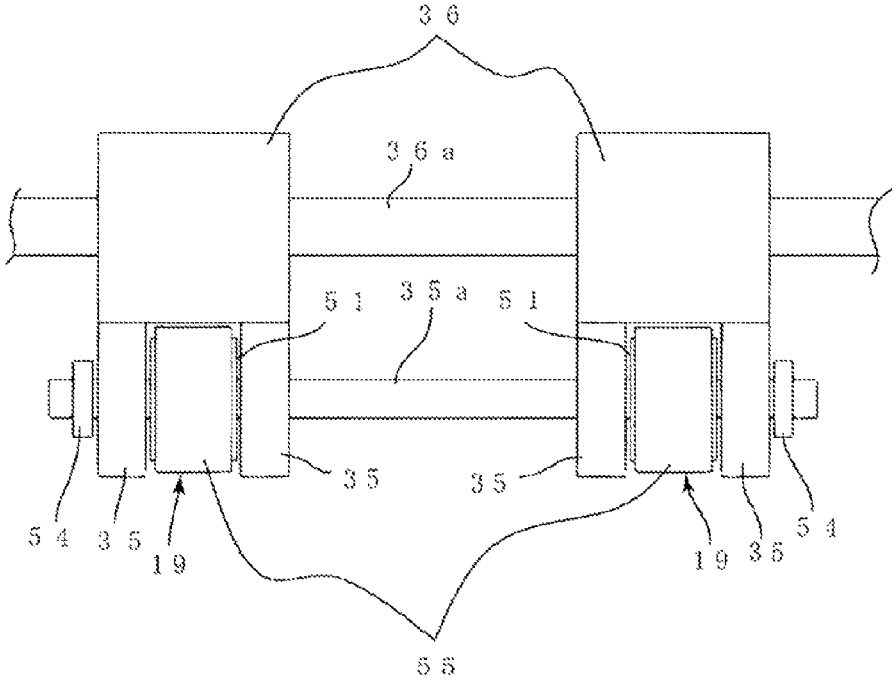

As illustrated in FIG. 4B, the outer diameter of the first belt support member 51 is set to be a size at a degree so that the surface of the conveying belt 55 is not protruded from the conveying wheels 35, 35 at both sides to the surface side in a state that the conveying belt 55 is wound thereaound. Accordingly, the conveying belt 55 is not abutted to the conveying roller 36 in a state that the conveying wheels 35, 35 at both sides are abutted to the conveying roller 36. Thus, the above structure prevents a sheet S from being nipped and conveyed by a conveying pair of rubber (i.e., the conveying roller 36) and rubber (i.e., the conveying belt 55).

As illustrated in FIG. 4A, guides 38, 39, 40 are supported at the apparatus body side of the image forming apparatus 10 in a predetermined state. The second belt support roller 37 is rotatably supported by the rotation shaft 29 of which both ends in the axial direction is supported by a bracket 56 fixed to a guide 38. Here, conveying guide faces of the above are indicated by numerals 38*a*, 39*a*, 40*a*, respectively.

As illustrated in FIG. 2, an arm member 54 is supported at one end thereof by the rotation shaft 29 which is supported by the bracket 56 so as to be swingable in the direction of arrow D of FIG. 2. The conveying wheel 35 and the first belt support roller 51 are supported by the other end of the arm member 54 via the rotation shaft 35*a*. The conveying wheel 35 supported as being swingable about the center O of the rotation shaft 29 in the direction of arrow D is pressed toward the conveying roller 36 by a spring (not illustrated).

That is, as illustrated in FIG. 4B, four conveying wheels 35 and two first belt support rollers 51 axially supported as being sandwiched by two conveying wheels 35 respectively, are supported at both ends of the rotation shaft 35*a* which is supported by the arm members 54, 54. With the above structure, the sheet S can be smoothly conveyed to the downstream side as being nipped by the conveying roller 36 and the conveying wheel 35.

As illustrated in FIG. 4A, the center O of the second belt support roller 37 which stretches the conveying belt 55 positions at the third conveying path 102 side from a tangent line L lined from a nip point between the conveying roller 33 and the retard roller 34 as passing on a top part of the conveying guide face 39*a* of the guide 39. Accordingly, the top end of the sheet S conveyed from the first conveying path 101 can be appropriately abutted to a tension portion X2 of the conveying belt 55.

Figure 7:
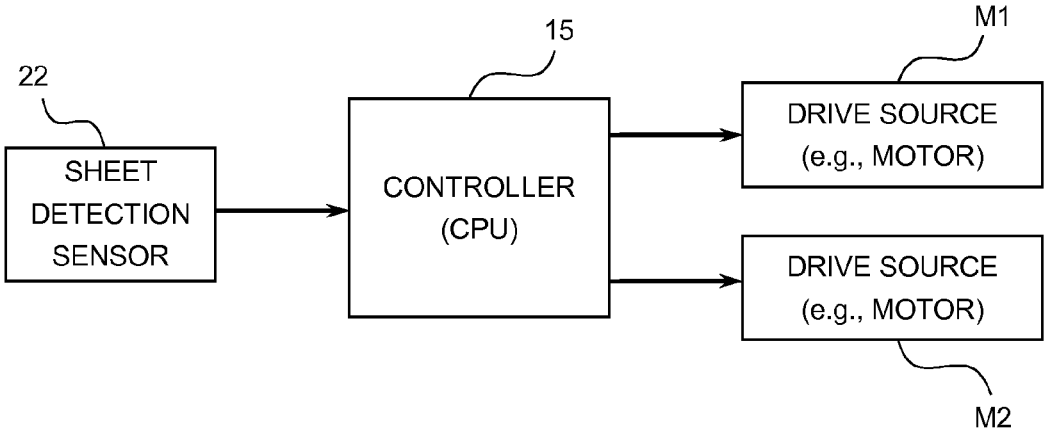
FIG. 7 is a block diagram illustrating a control system of the first embodiment.

Here, a control system of the present embodiment is described with reference to FIG. 7. As illustrated in FIG. 7, a controller (CPU) 15 arranged in the apparatus body of the image forming apparatus 10 receives input of a detection signal from a sheet detection sensor 22 which detects the sheet S passing though the first conveying path 101, the third conveying path 102, the curved portion 103, and the second conveying path 104. A drive source M1 such a motor which drives the first conveying portion (i.e., the other drive conveying portion) 17 as rotating the conveying roller 33 and the retard roller 34 is connected to the controller 15. Further, a drive source M2 such as a motor which drives the second conveying portion (i.e., the drive conveying portion) 18 and the belt conveying portion 19 as rotating the conveying roller 36 is connected to the controller 15. The controller 15 controls the drive sources M1, M2 based on the detection signal of the sheet detection sensor 22.

Figure 6:
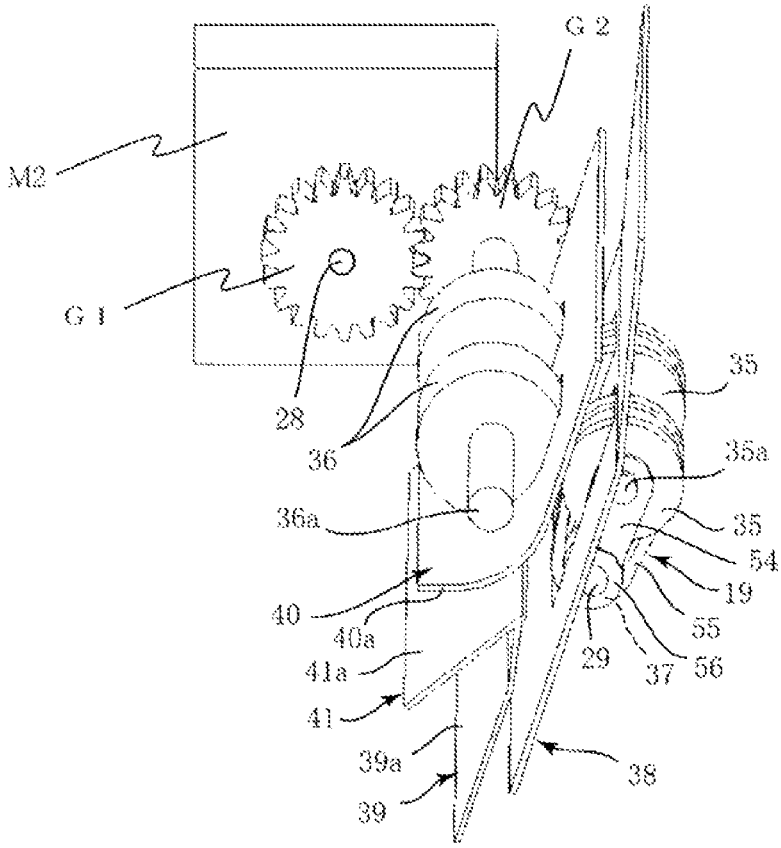
FIG. 6 is a perspective view illustrating a drive source in the first embodiment.

As illustrated in FIG. 6, driving force of the drive source M2 is transmitted from a rotation shaft 28 to a transmission gear G1 and is further transmitted to a rotation shaft 36*a* via a shaft gear G2 which is engaged with the transmission gear G1, so that the conveying roller 36 is rotated. Then, the driving force of the drive source M2 is transmitted from the conveying roller 36 to the rotation shaft 35*a* supporting the conveying wheel 35 via the conveying wheel 35 which is abutted to the conveying roller 36 and is transmitted to the conveying belt 55 via the first belt support roller 51 which is supported by the rotation shaft 35*a*. In the present embodiment, since the belt conveying portion 19 is configured to be capable of being driven by the drive source M2 which is commonly used to the second conveying portion 18 as described above, the structure thereof is simplified.

In the present embodiment, the conveying belt (i.e., the belt member) 55 is formed of high slidability material at least at the outer circumferential face. That is, the conveying belt 55 is formed of EPDM-based rubber material and the outer circumferential face of the conveying belt 55 is coated with silicon-based (i.e., silicone-based) material having a low friction coefficient (i.e., high slidability material). Further, the conveying wheel 35 being a driven roller pressed to the conveying roller 36 is formed of synthetic resin material such as ABS resin and POM resin (i.e., polyacetal resin).

In the above sheet conveying apparatus, the conveying roller 36 and the conveying wheel 35 corresponding to the sheet cassette 31 at the upper stage convey a sheet S conveyed to the curved portion 103 via the first conveying path 101 and a sheet S conveyed via the first conveying path 101 respectively to the downstream side of the second conveying path 104. Meanwhile, the conveying roller 36 and the conveying wheel 35 corresponding to the sheet cassette 31 at the lower stage convey a sheet S fed to the curved portion 103 via the third conveying path 102 to the downstream side of the second conveying path 104. Further, the conveying roller 36 and the conveying wheel 35 corresponding to the duplex conveying path 62 convey a sheet S fed from the duplex conveying path 62 to the curved portion 103 via the first conveying path 101 and a sheet S conveyed via the third conveying path 102 respectively to the downstream side of the second conveying path 104.

Figure 5A:
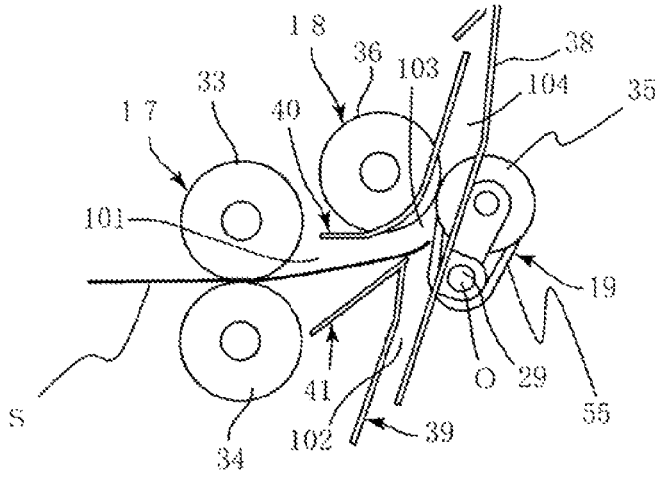
FIGS. 5A to 5C are side views illustrating motion of a sheet in the first embodiment.

Next, operation of the present embodiment will be described with reference to FIGS. 5A to 5C. First, when a sheet S is conveyed from the first conveying path 101 to the curved portion 103 in a state that the conveying roller 36 is rotated counterclockwise and the conveying wheel 35 and the conveying belt 55 are rotated clockwise as being controlled by the controller 15, the following situation occurs. That is, the top end of the sheet S is abutted to the tension portion X2 of the conveying belt 55 (see FIG. 4A), as illustrated in FIG. 5A. In this case, since impact due to collision of the top end of the sheet S is softened by tension elasticity of the conveying belt 55, noise occurrence at the time of collision is effectively suppressed.

Figure 5B:
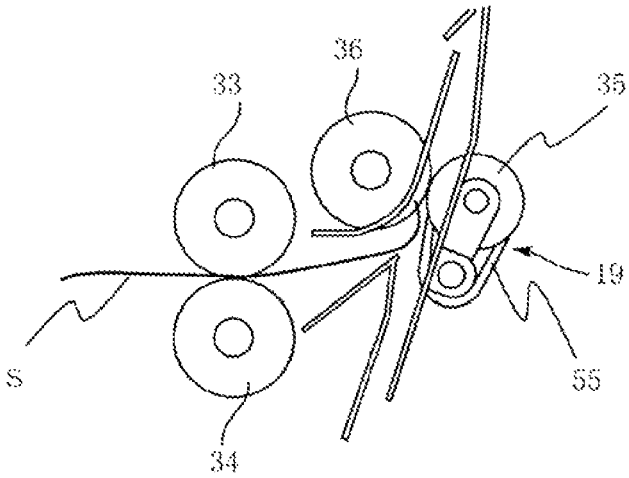

Then, as illustrated in FIG. 5B, the top end of the sheet S is passed and moved upward by the rotating conveying belt 55. At that time, since the surface of the conveying belt 55 is coated with silicone-based material having a low friction coefficient (i.e., high slidability material), the sheet top end is prevented from being stuck to the surface of the conveying belt 55. Accordingly, the top end of the sheet S enters toward the nip of the conveying roller 36 and the conveying wheel 35 as being guided with contacting to the conveying belt 55.

Figure 5C:
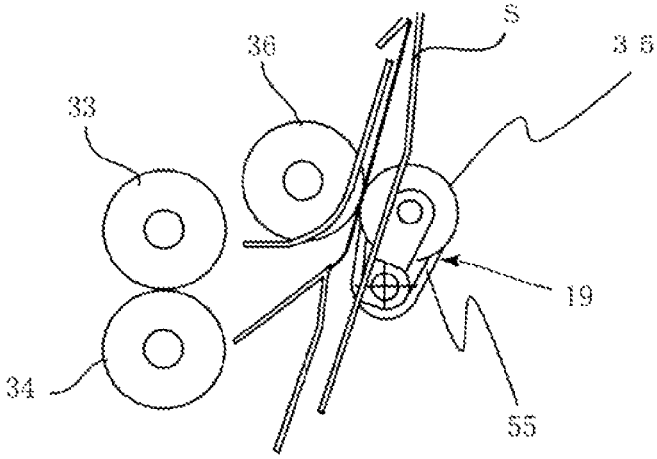

Subsequently, when the rear end of the sheet S conveyed by the second conveying portion 18 passes through the first conveying path 101 as illustrated in FIG. 5C, the rear end is about to collide with the guide 38 as being bounced in a restoration direction owing to elastic force of the sheet S. However, since the sheet rear end is abutted to the conveying belt 55 without colliding with the guide 38, the impact thereof is softened by tension elasticity of the conveying belt 55. Accordingly, occurring noise can be effectively suppressed. Subsequently, the sheet S is conveyed to the downstream side as being nipped by the nip of the conveying roller 36 and the conveying wheel 35. Then, an image is transferred at the image forming portion 2 as the surface to which the conveying wheel 35 is contacted being a toner transfer face (i.e., an image transfer face).

According to the present embodiment, when the sheet S conveyed from the first conveying path 101 is conveyed to the second conveying path 104, the sheet S can be conveyed only by nipping between the conveying roller 36 and the conveying wheel 35 without contact between the conveying belt 55 and the conveying roller 36. Accordingly, it is possible to reliably prevent occurrence of inconvenience such that imaging instability becomes apparent as a result of occurrence of large frictional charging difference between a nipped part and an un-nipped part of the sheet S caused by sheet nipping with a rubber-made roller body and a rubber-made endless belt in the related art. In this manner, occurrence of imaging failure can be avoided while reducing noise occurring at the vicinity of the curved portion 103.

Figure 8:
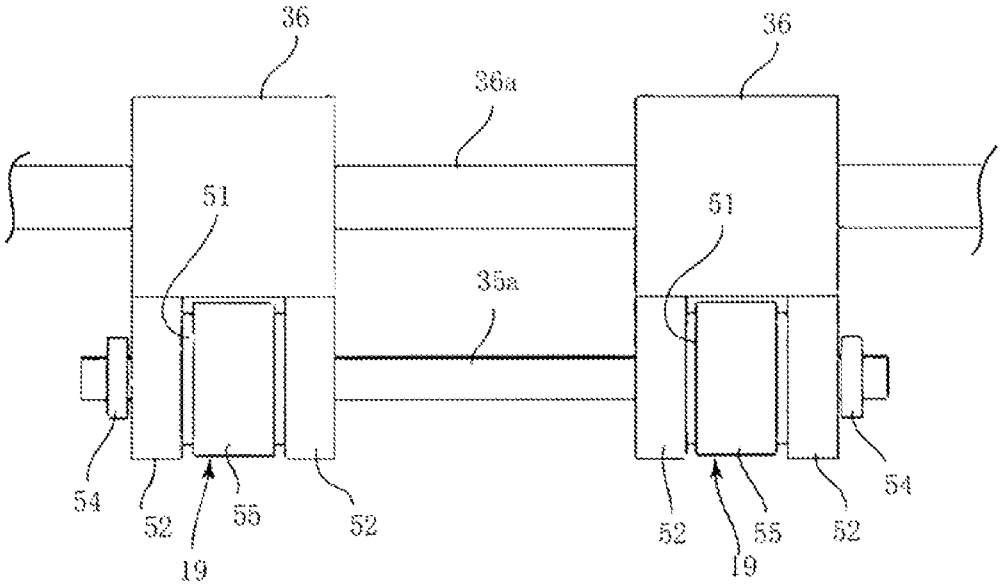
FIG. 8 is a plane view illustrating a first modification in which the conveying wheel is modified in shape.

<First Modification> In the present embodiment, the conveying wheel 35 and the first belt support roller 51 which stretches the conveying belt 55 are fixed and supported separately by the rotation shaft 35*a* as being prepared as separate members. However, the present invention is not limited to the above. That is, as the first modification illustrated in FIG. 8, conveying wheels 52, 52 having a larger diameter than the first belt support roller 51 are integrally formed at both sides of the first belt support roller 51, and then, the first belt support roller 51 is rotated integrally with the conveying wheels 52, 52 which are rotated by the conveying roller 36.

According to the first modification, the rotation shaft 35*a* is only required to be configured to simply support the conveying wheels 52, 52 and the first belt support roller 51 being rotatable in a state that both ends thereof are simply supported by arm members 54, 54 without being required to be rotatably supported. With the above structure, it is possible to obtain an effect of structural simplification.

Second Embodiment

Next, a second embodiment of the present invention will be described. In the present embodiment, the mechanical structure is the same as the first embodiment only with different control. Accordingly, the same numeral is given to the same part and description thereof will not be repeated. Here, the present embodiment will be described mainly on operation thereof by utilizing operational views of FIGS. 9A to 9D and a flowchart of FIG. 10.

In the present embodiment, conveyance speeds V1, V2, and V3 set to satisfy relation of "V1>V2>V3" are utilized for description of conveyance speeds of the conveying roller 33, the conveying roller 36, and the conveying belt 55. The difference among the above conveyance speeds are derived from relation among the conveying roller 36, the conveying wheel 35 of which outer diameter is smaller than that of the conveying roller 36, and the conveying belt 55 which is wound around the first belt support roller 51 having a small diameter and the second belt support roller 37.

In the present embodiment, the controller 15 controls the driving of the drive sources M1, M2 such as motors (see FIG.

7) based on sheet detection by the sheet detection sensor 22. Accordingly, control is performed as setting the conveying belt 55 at the conveyance speed V2 by setting the conveying roller 36 at the conveyance speed V1 or as setting the conveying belt 55 at the conveyance speed V3 by setting the conveying roller 36 at the conveyance speed V2, while setting the conveying roller 33 constantly at the conveyance speed V2. That is, when there is not a sheet S at the nip of the second conveying portion 18 of the present embodiment, the second conveying portion 18 is controlled to be switched to the conveyance speed V1 being faster than the conveyance speed V2 of the first conveying portion (i.e., the other drive conveying portion) 17. On the contrary, when there is a sheet S at the nip of the second conveying portion 18, the second conveying portion 18 is controlled to be switched to the conveyance speed V2 being equal to the conveyance speed V2 of the first conveying portion 17.

Figure 9A:
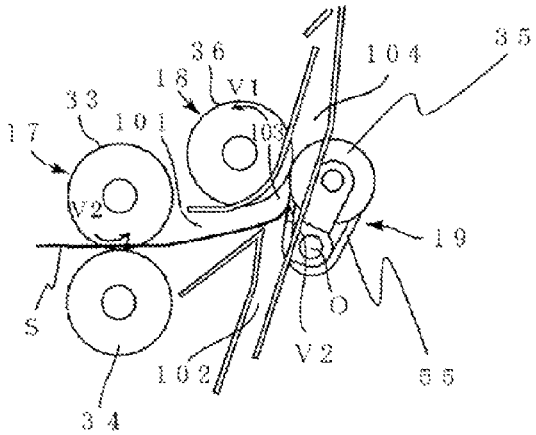
FIGS. 9A to 9D are side views illustrating motion of a sheet in a second embodiment of the present invention.
Figure 10:
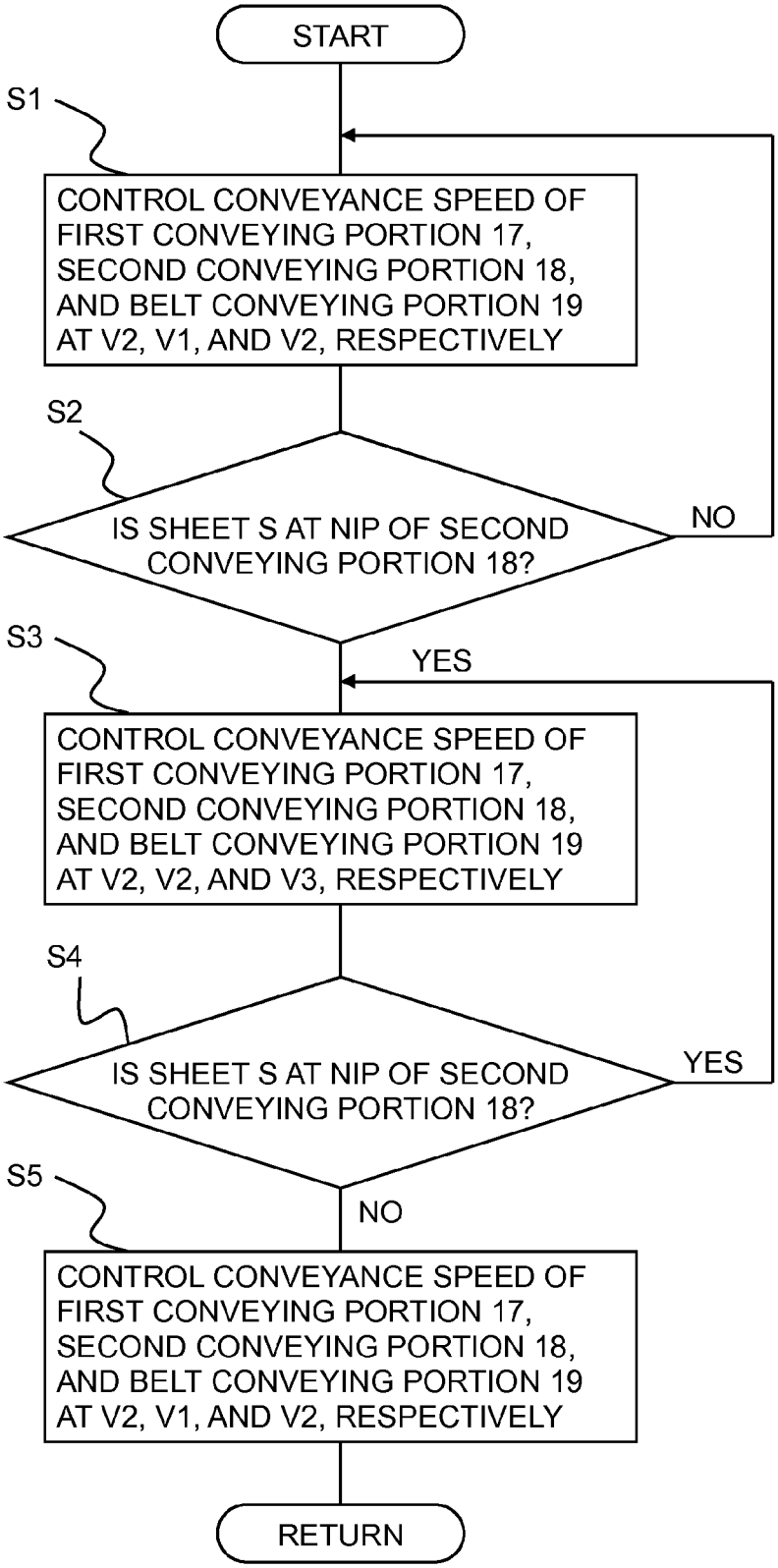
FIG. 10 is a flowchart illustrating operation in the second embodiment.

Here, in the sheet conveying apparatus, prior to conveying of the sheet S, control is performed as illustrated in FIG. 9A. That is, the drive sources M1, M2 are each controlled by the controller 15 so that the first conveying portion 17 is at the conveyance speed V2, the second conveying portion 18 is at the conveyance speed V1 being faster than the conveyance speed V2, and the belt conveying portion 19 is at the conveyance speed V2 obtained according to the conveyance speed V1 of the conveying roller 36 (step S1).

In the above state, when the sheet S is conveyed from the first conveying path 101 to the curved portion 103, the top end of the sheet S is abutted to the conveying belt 55. Then, based on the detection signal of the sheet detection sensor 22 (see FIG. 7), the controller 15 determines whether there is a sheet S at the nip of the second conveying portion 18 (step S2). As a result, when it is determined that there is not a sheet S at the nip of the second conveying portion 18 ("No" in step S2), the control of step S1 is repeated.

Figure 9B:
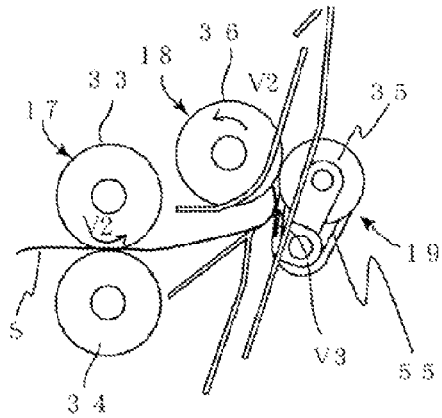

On the contrary, when it is determined that there is a sheet S at the nip of the second conveying portion 18 ("Yes" in step S2), the controller 15 controls the drive sources M1, M2 so that the first conveying portion 17 is at the conveyance speed V2, the second conveying portion 18 is at the conveyance speed V2, and the belt conveying portion 19 is at the conveyance speed V3 (step S3), as illustrated in FIG. 9B. Since the conveyance speed of the second conveying portion 18 becomes equal to the conveyance speed V2 of the first conveying portion 17, it is possible to prevent occurrence of inconvenience such that the sheet S is pulled while conveying is performed by the second conveying portion 18 in a state that the sheet rear end side is nipped by the nip of the first conveying portion 17. Here, similarly to the first embodiment, it is possible to obtain the effect of suppressing noise occurrence at the time of collision of the top end of the sheet S by softening impact due to the collision.

Figure 9C:
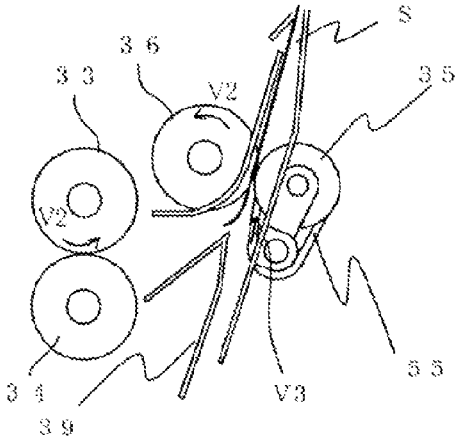
Figure 9D:
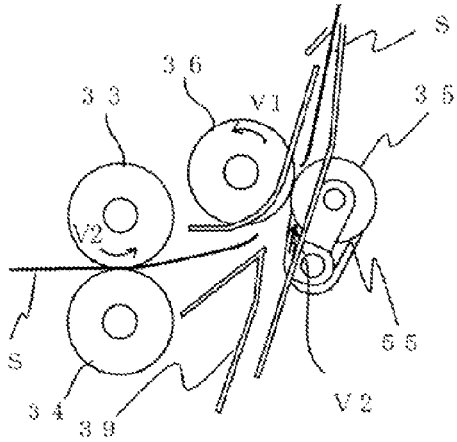

Subsequently, as illustrated in FIG. 9C, the top end of the sheet S is guided while being moved upward as keeping contact with the conveying belt 55 and enters toward the nip of the second conveying portion 18. While it is determined that there is a sheet S at the nip of the second conveying portion 18 ("Yes" in step S4), the controller 15 repeats the control of step S3.

Further, the controller 15 determines whether there is a sheet S at the nip of the second conveying portion 18 based on the detection signal of the sheet detection sensor 22 (step S4). Here, the sheet S is conveyed to the downstream side at the conveyance speed V2 by the second conveying portion 18 and the rear end collides with the conveying belt 55 which is rotated at the conveyance speed V3. The impact at that time is appropriately softened by the conveying belt 55. Accordingly, similarly to the first embodiment, the effect of suppressing occurring noise can be obtained.

When it is determined that there is not a sheet S at the nip of the second conveying portion 18 in step S4 ("No" in step S4), the processing proceeds to step S5. That is, the sheet S is conveyed to the downstream side as being nipped at the second conveying portion 18. Then, when the sheet S passes through the nip of the second conveying portion 18, the controller 15 increases the conveyance speed of the second conveying portion 18 from V2 to V1 while keeping the first conveying portion 17 at the conveyance speed V2. Accordingly, the conveyance speed of the belt conveying portion 19 is increased from V3 to V2 to return to the initial state of FIG. 9A.

In the present embodiment, the outer circumferential face of the conveying belt 55 may be coated with material having a low friction coefficient as the first embodiment. However, the similar effect can be obtained even without the coating. Further, in the present embodiment, the conveyance speed of the belt conveying portion 19 at the initial state is controlled to be equal to the conveyance speed V2 of the conveying roller 33. However, it is not limited to the above. For example, the drive source M2 is controlled so that the conveying belt 55 of the belt conveying portion 19 is at conveyance speed being faster than the conveyance speed V2 when conveyance efficiency of the sheet top end due to the belt conveying portion 19 is not sufficient. In this case, the conveying capability of the sheet top end can be improved.

Third Embodiment

Next, a third embodiment of the present invention will be described with reference to FIG. 11. In the present embodiment, similarly to the first embodiment, the conveying roller 36 is configured to be rotated by driving of the drive source M2 to transmit rotation to the conveying wheel 35. Here, the driving of the belt conveying portion 19 is configured as follows.

Figure 11:
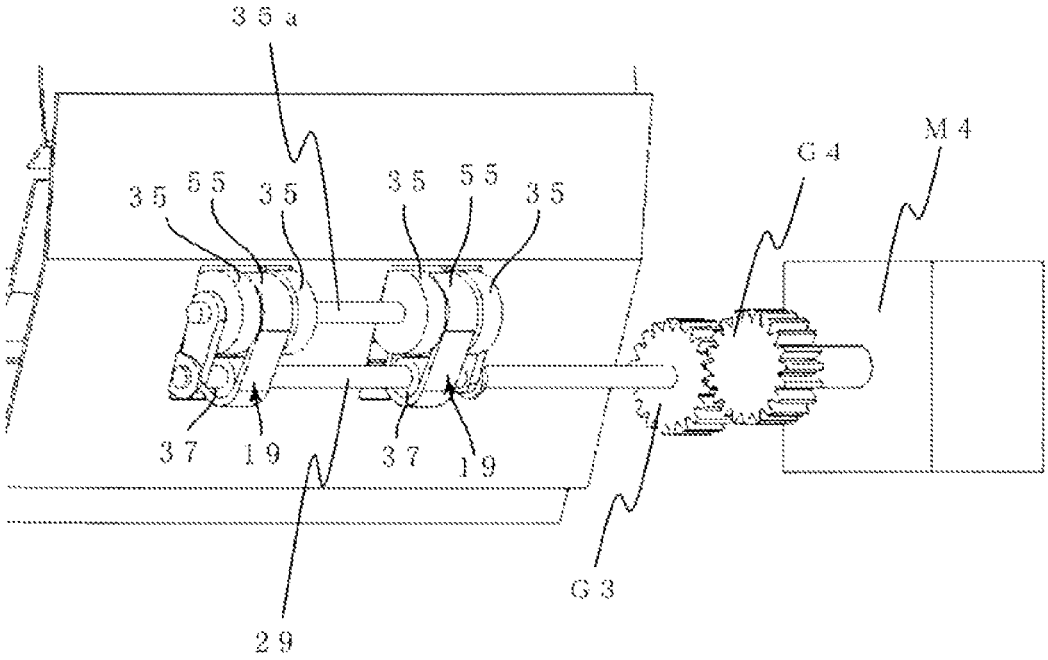
FIG. 11 is a perspective view of a third embodiment having a structure in which driving force is directly applied to an endless conveying belt from a drive source.
Figure 12A:
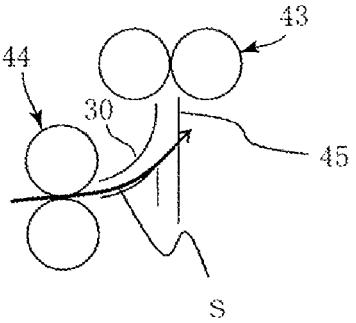
FIG. 12A PRIOR ART
FIGS. 12A and 12B are side views illustrating a structure in the related art.
Figure 12B:
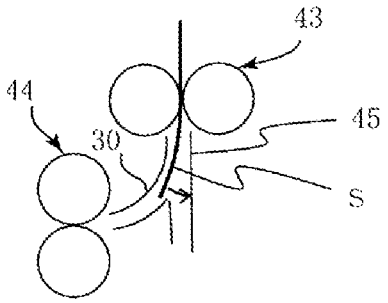
FIG. 12B PRIOR ART

As illustrated in FIG. 11, driving is transmitted from a drive source M4 such as a motor arranged at the apparatus body side to the rotation shaft 29 of the second belt support roller 37 via a transmission gear G4 and a drive gear G3 which is engaged with the transmission gear G4. Here, any of four conveying wheels 35 is not drive-connected to the rotation shaft 35*a* and the second belt support roller 37 is drive-connected to the rotation shaft 29. Accordingly, conveyance speed of the conveying belt 55 at the belt conveying portion 19 can be set with control of the controller 15 without relation to the conveying roller 36 and the conveying wheel 35. In this manner, the belt conveying portion 19 of the present embodiment is configured to be capable of being driven independently from the second conveying portion 18 by the drive source M4 being different from the drive source M2 of the second conveying portion 18.

According to the above structure, rotation speed of the drive source M2 is not required to be switched based on detection of the sheet detection sensor 22 not like the second embodiment. Therefore, conveyance speed is continuously coordinated among the conveying belt 55, the conveying roller 36, and the conveying wheel 35.

Further, similarly to the second embodiment, it is also possible to control the drive source M4 so that the conveyance speed of the conveying belt 55 is set to be faster than the conveyance speed V2 when conveyance efficiency of the sheet top end due to the conveying belt 55 is not sufficient. In this case, the conveying capability of the sheet top end can be improved. The rest of the structure and effects are the same as those of the first embodiment.

Here, it is also possible that the conveying belt 55 and the first belt support roller 51 are configured to be rotatable without being drive-connected to the rotation shaft 35*a*. In this case, inconvenience such that a sheet top end is folded can be reliably avoided by releasing force with rotation of the conveying belt 55 following the sheet S which receives conveying force from the conveying roller 33 when the sheet top end is abutted to the conveying belt 55 as illustrated in FIG. 5A, for example.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-281486, filed Dec. 17, 2010, which is hereby incorporated by reference herein in its entirety.

What is claimed is:

1. A sheet conveying apparatus comprising:

a curve-shaped conveying path which guides a sheet being conveyed in a first conveyance direction toward a second conveyance direction which is curved against the first conveyance direction;

a first drive conveying portion which is arranged at the curve-shaped conveying path and which conveys the sheet in the second conveyance direction with a nip of a pair of rollers being mutually-pressed; and a belt conveying portion which is arranged at a curved portion of the curve-shaped conveying path and which conveys the sheet conveyed in the first conveyance direction toward the first drive conveying portion with rotation of an endless belt member, wherein the belt conveying portion includes a first pulley which is arranged coaxially with one of the pair of rollers and a second pulley which is arranged upstream of the first drive conveying portion from the first pulley, the belt member being wound around the first and second pulley, and a distance from a rotation center of the first pulley to an outer surface of a portion of the belt member that is wound around the first pulley is smaller than a radius of the one of the pair of rollers.

2. The sheet conveying apparatus according to claim 1, wherein the first drive conveying portion is controlled to be switched to conveyance speed being different from conveyance speed of a second drive conveying portion which conveys the sheet in the first conveyance direction when there is not a sheet at the nip of the pair of rollers and is controlled to be switched to conveyance speed being equal to the conveyance speed of the second drive conveying portion when there is a sheet at the nip of the pair of rollers.

3. The sheet conveying apparatus according to claim 1, wherein the belt conveying portion is configured to be capable of being driven independently from the first drive conveying portion by a drive source being different from a drive source of the first drive conveying portion.

4. The sheet conveying apparatus according to claim 1, wherein the belt conveying portion is arranged at a side where the belt member is contacted to an image transfer face of a sheet to be conveyed.

5. An image forming apparatus comprising:

a sheet conveying apparatus including:

a curve-shaped conveying path which guides a sheet being conveyed in a first conveyance direction toward a second conveyance direction which is curved against the first conveyance direction;

a first drive conveying portion which is arranged at the curve-shaped conveying path and which conveys the sheet in the second conveyance direction with a nip of a pair of rollers being mutually-pressed; and a belt conveying portion which is arranged at a curved portion of the curve-shaped conveying path and which conveys the sheet conveyed in the first conveyance direction toward the first drive conveying portion with rotation of an endless belt member, the belt conveying portion being configured to include a first pulley which is arranged coaxially with one of the pair of rollers and a second pulley which is arranged upstream of the first drive conveying portion from the first pulley, the belt member being wound around the first and second pulley, and a distance from a rotation center of the first pulley to an outer surface of a portion of the belt member that is wound around the first pulley is smaller than a radius of the one of the pair of rollers; and an image forming portion which forms an image on a sheet conveyed from the sheet conveying apparatus.

6. The image forming apparatus according to claim 5, wherein the first drive conveying portion is controlled to be switched to conveyance speed being different from conveyance speed of a second drive conveying portion which conveys the sheet in the first conveyance direction when there is not a sheet at the nip of the pair of rollers and is controlled to be switched to conveyance speed being equal to the conveyance speed of the second drive conveying portion when there is a sheet at the nip of the pair of rollers.

7. The image forming apparatus according to claim 5, wherein the belt conveying portion is configured to be capable of being driven independently from the first drive conveying portion by a drive source being different from a drive source of the first drive conveying portion.

8. The image forming apparatus according to claim 5, wherein the belt conveying portion is arranged at a side where the belt member is contacted to an image transfer face of a sheet to be conveyed.

* * * * *